US009460867B2

(12) United States Patent
Gottschalk

(10) Patent No.: US 9,460,867 B2
(45) Date of Patent: Oct. 4, 2016

(54) ELECTRICAL SWITCHING APPARATUS AND POLE SHAFT ASSEMBLY THEREFOR

(71) Applicant: EATON CORPORATION, Cleveland, OH (US)

(72) Inventor: Andrew Lawrence Gottschalk, Monaca, PA (US)

(73) Assignee: EATONG CORPORATION, Cleveland, OH (US)

( * ) Notice: Subject to any disclaimer, the term of this patent is extended or adjusted under 35 U.S.C. 154(b) by 231 days.

(21) Appl. No.: 14/277,346

(22) Filed: May 14, 2014

(65) Prior Publication Data

US 2015/0332871 A1 Nov. 19, 2015

(51) Int. Cl.
*H01H 1/00* (2006.01)
*H01H 33/664* (2006.01)

(52) U.S. Cl.
CPC ..... *H01H 1/00* (2013.01); *H01H 33/6643* (2013.01)

(58) Field of Classification Search
CPC .... H01H 1/00; H01H 71/505; H01H 11/042; H01H 1/5833; H01H 2011/047; H01H 3/30; H01H 3/3015; H01H 3/3031; H01H 3/3021; H01H 2003/3063
USPC ..... 200/238, 400, 401, 337, 17 R, 500–501, 200/424
See application file for complete search history.

(56) References Cited

U.S. PATENT DOCUMENTS 2,528,548 A * 11/1950 Reilly ..... H01H 33/02 200/273
2,860,417 A * 11/1958 Knight ..... E21B 47/04 33/544
3,012,800 A * 12/1961 Koch ..... H01H 50/30 29/517
5,266,760 A * 11/1993 Link ..... H01H 71/0257 200/244
8,507,817 B2 * 8/2013 Gottschalk ..... H01H 11/00 200/401

* cited by examiner

*Primary Examiner* — Edwin A. Leon
(74) *Attorney, Agent, or Firm* — Eckert Seamans Cherin & Mellott, LLC; Grant E. Coffield

(57) ABSTRACT

A pole shaft assembly is for an electrical switching apparatus. The electrical switching apparatus includes a housing, separable contacts enclosed by the housing, and an operating mechanism structured to open and close the separable contacts. The pole shaft assembly includes a shaft structured to cooperate with the operating mechanism and to be pivotably coupled to the housing. A number of throw assemblies are disposed on the shaft, and are secured with respect to the shaft with fasteners. The shaft includes first and second opposing ends and an elongated body portion extending therebetween. The elongated body portion of the shaft has a cross-sectional shape comprising a number of orienting features.

17 Claims, 4 Drawing Sheets

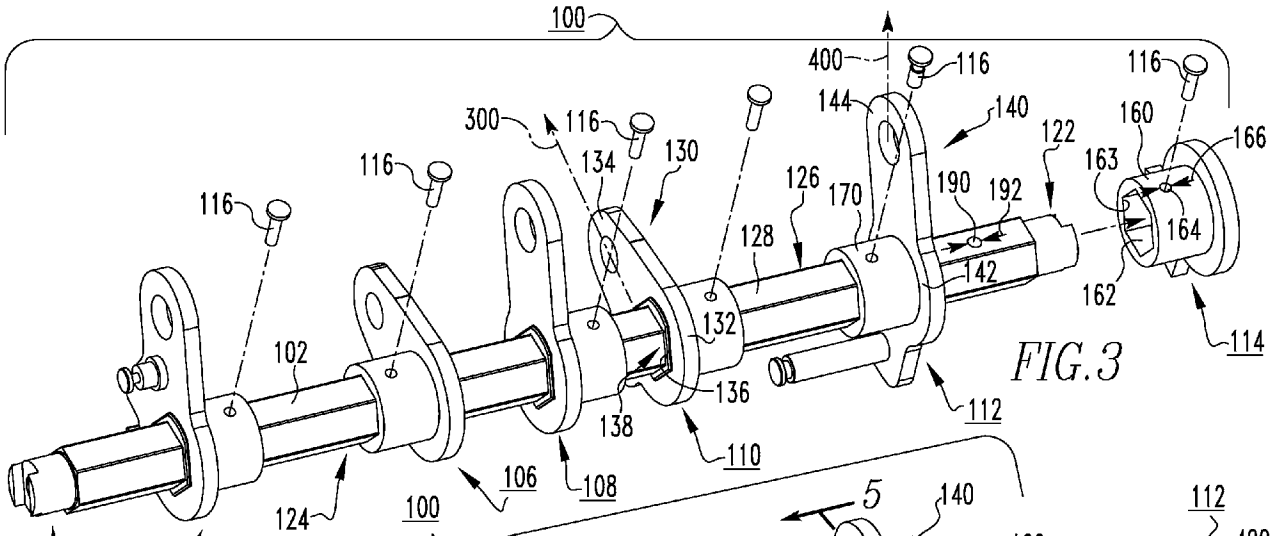
FIG. 3
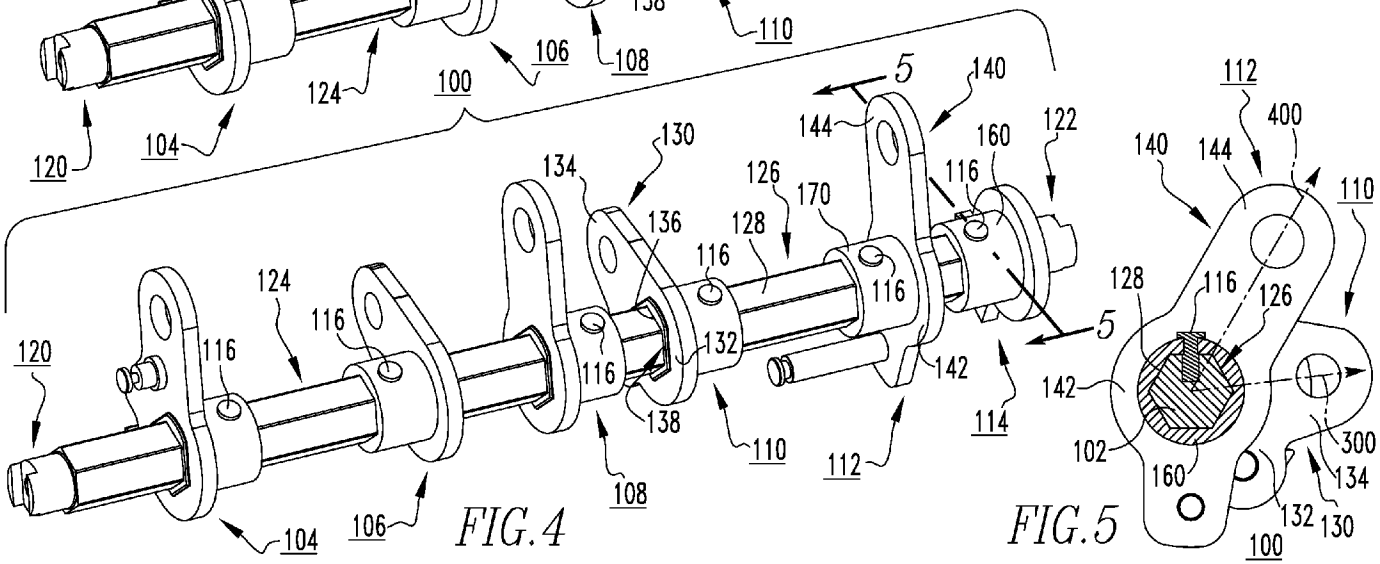
FIG. 4
FIG. 5

ELECTRICAL SWITCHING APPARATUS AND POLE SHAFT ASSEMBLY THEREFOR

BACKGROUND

1. Field

The disclosed concept relates generally to electrical switching apparatus and, more particularly, to electrical switching apparatus such as, for example, circuit breakers. The disclosed concept also relates to pole shaft assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens separable electrical contacts to interrupt the flow of current through the conductors of an electrical system in response to such fault conditions as detected, for example, by a trip unit.

Among other components, the operating mechanisms of some low and medium voltage circuit breakers, for example, typically include a closing assembly and an opening assembly that are structured to close (e.g., contacts electrically connected) and open (e.g., contacts separated), respectively, the separable contacts. Specifically, the operating mechanism includes a pivotable pole shaft, a number of stored energy devices such as, for example, an opening spring and a closing spring, and a latch assembly that cooperates directly or indirectly with the pole shaft to facilitate desired movement of the separable contacts.

The pole shaft generally includes an elongated shaft and a number of throws that extend outwardly from and pivot with the elongated shaft to actuate or otherwise cooperate with a variety of different circuit breaker components such as, for example and without limitation, a trip paddle of the trip assembly. The throws are typically welded to the elongated shaft. In order for the operating mechanism to operate properly, a precise trip paddle force is required. Therefore, the throws must be precisely and accurately positioned as the parts are welded together. Any shifting or warping of the components results in a change of the forces applied by the pole shaft throws.

There is room for improvement in electrical switching apparatus, such as circuit breakers, and in pole shaft assemblies therefor.

SUMMARY

These needs and others are met by embodiments of the disclosed concept, which are directed to a pole shaft assembly for electrical switching apparatus.

As one aspect of the disclosed concept, a pole shaft assembly is provided for an electrical switching apparatus. The electrical switching apparatus comprises a housing, separable contacts enclosed by the housing, and an operating mechanism structured to open and close the separable contacts. The pole shaft assembly comprises: a shaft structured to cooperate with the operating mechanism and to be pivotably coupled to the housing; a number of throw assemblies disposed on the shaft; and a number of fasteners. Each of the fasteners secures a corresponding one of the throw assemblies with respect to the shaft.

The shaft may include a first end, a second end disposed opposite and distal from the first end, and an elongated body portion extending between the first end and the second end.

The elongated body portion of the shaft may have a cross-sectional shape comprising a number of orienting features. Each of the throw assemblies may comprise a throw including an attachment portion attached to the shaft, and an extension portion extending outwardly from the shaft. The attachment portion may include an aperture, wherein the aperture has a shape substantially similar to the cross-sectional shape of the elongated body portion of the shaft. The elongated body portion of the shaft may have a hexagonal cross-sectional shape, and the aperture of the throw may have a corresponding hexagonal shape.

Each of the throw assemblies may further comprise at least one collar disposed on the elongated body portion adjacent to the throw. The collar may include a through hole, and the elongated body portion of the shaft may include a number of receiving holes. The through hole may be aligned with a corresponding one of the receiving holes to receive a corresponding one of the fasteners. The fasteners may be blind rivets.

BRIEF DESCRIPTION OF THE DRAWINGS

A full understanding of the disclosed concept can be gained from the following description of the preferred embodiments when read in conjunction with the accompanying drawings in which:

FIG. 3 is a partially exploded isometric view of the pole shaft assembly of FIG. 2;

FIG. 4 is an assembled isometric view of the pole shaft assembly of FIG. 3;

FIG. 5 is a section view taken along line 5-5 of FIG. 4;

DESCRIPTION OF THE PREFERRED EMBODIMENTS

As employed herein, the statement that two or more parts are "coupled" together shall mean that the parts are joined together either directly or joined through one or more intermediate parts.

As employed herein, the term "fastener" refers to any suitable connecting or tightening mechanism expressly including, but not limited to, rivets (e.g., without limitation, blind rivets; solid rivets), screws, bolts and the combinations of bolts and nuts (e.g., without limitation lock nuts) and bolts, washers and nuts.

As employed herein, the term "number" shall mean one or an integer greater than one (i.e., a plurality).

Figure 1:
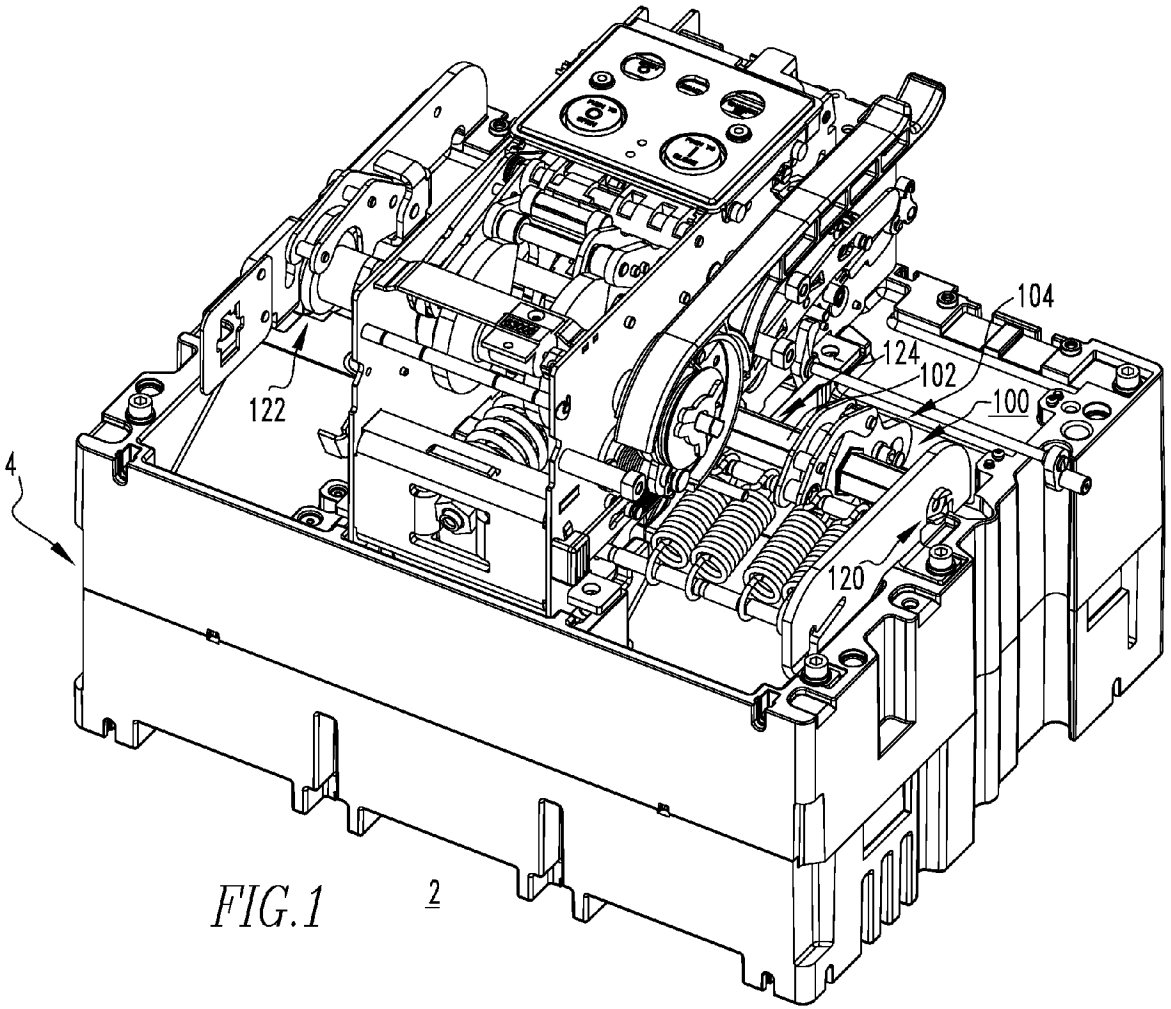
FIG. 1 is an isometric view of a circuit breaker and pole shaft assembly therefor, in accordance with an embodiment of the disclosed concept.
Figure 2:
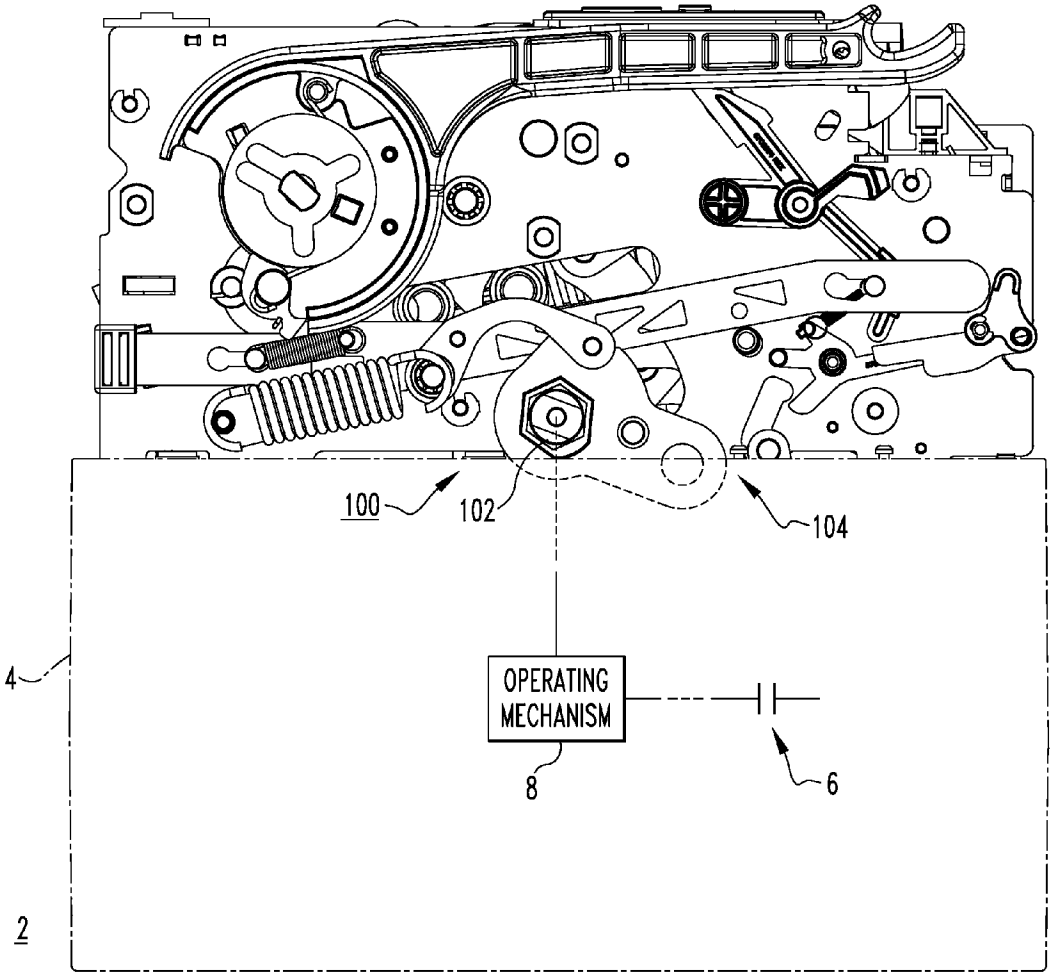
FIG. 2 is a side elevation view of the circuit breaker and pole shaft assembly therefor of FIG. 1, showing portions of the circuit breaker in simplified form.

FIGS. 1-5 show a pole shaft assembly 100 for an electrical switching apparatus such as, for example and without limitation, a circuit breaker 2 (FIGS. 1 and 2). The circuit breaker 2 (FIGS. 1 and 2) includes a housing 4 (partially shown with the cover removed in FIG. 1; shown in simplified form in phantom line drawing in FIG. 2), separable contacts 6 (shown in simplified form in FIG. 2) enclosed by the housing 4, and an operating mechanism 8 (shown in simplified form in FIG. 2) structured to open and close the separable contacts 6.

As best shown in FIGS. 3-5, the pole shaft assembly 100 includes a shaft 102, which is structured to cooperate with the circuit breaker operating mechanism 8 (FIG. 2) and to be pivotably coupled to the circuit breaker housing 4 (see, for example, FIG. 1). A number of throw assemblies 104, 106, 108, 110, 112, 114 (six are shown) disposed on the shaft 102. Fasteners 116 (e.g., without limitation, rivets) secure the throw assemblies 104, 106, 108, 110, 112, 114 with respect to the shaft 102. As will be described in greater detail hereinbelow, among other benefits, the unique structure of the shaft 102 and components of the disclosed pole shaft assembly 100 very accurately and precisely position the throw assemblies 104, 106, 108, 110, 112, 114 for proper operation of the circuit breaker 2 (FIGS. 1 and 2) and, in particular, components (e.g., without limitation, operating mechanism 8 (FIG. 2); trip assembly (not shown); trip paddle (not shown)) with which the pole shaft assembly 100 interacts. Thus, the disclosed concept overcomes known disadvantages (e.g., without limitation, complexity; cost; warping) associated with prior art pole shaft designs (not shown), for example, wherein the throw assemblies are welded to the shaft.

Continuing to refer to FIGS. 3-5, the shaft 102 includes a first end 120, a second end 122 disposed opposite and distal from the first end 120, and an elongated body 124 extending between the first and second ends 120,122. The elongated body portion 124 of the shaft 102 preferably has a cross-sectional shape 126 incorporating a number of orienting features 128. The orienting features (e.g., without limitation, planar segments 128) serve to position (i.e., orient) components to the shaft 102 very precisely and accurately in a specific predetermined configuration, as well as to prevent the components from undesirably moving from such predetermined position. Stated another way, the unique configuration of the components and shaft 102 advantageously allow the components to "self clock" (i.e., establish and maintain a desired predetermined position) with respect to the shaft 102. In the example shown and described herein, the shaft 102 has a hexagonal cross-sectional shape 126, and the number of orienting features is the plurality of planar segments or surfaces 128 of the hexagonal cross-sectional shape 126 (best shown in the section view of FIG. 5). It will be appreciated, however, that the elongated body portion 124 of the shaft 102 could have any known or suitable alternative cross-sectional shape (not shown) and/or number, type and/or configuration of orienting features (e.g., without limitation, a key; a spline; a shape other than a hexagon (not shown)), without departing from the scope of the disclosed concept.

For economy of disclosure and ease of illustration, only two of the throw assemblies 110,112 are shown and described herein, in detail. It will be appreciated, however, that the remaining throw assemblies 104, 106, 108, 114 preferably have a similar construction and preferably function in substantially the same manner. Each of the throw assemblies 110,112 includes a throw 130,140 having an attachment portion 132,142 and an extension portion 134, 144, respectively. The attachment portions 132,142 are attached to the shaft 102, and the extension portions 134,144 extend outwardly from the shaft 102, as shown. Referring to throw 130 of FIGS. 3 and 4, it will be appreciated that the attachment portion 132 includes an aperture 136, which preferably has a shape 138 substantially similar to the cross-sectional shape 126 of the elongated body portion 124 of the shaft 102. In the non-limiting example shown, the aperture 136 of the throw 130 has a hexagonal shape 138 corresponding to hexagonal cross-sectional shape 126 of the shaft body portion 124.

Continuing to refer to FIGS. 3 and 4, each of the throw assemblies 110,112 further includes at least one collar 160, 170 disposed on the elongated body portion 124 adjacent to the corresponding throw 130,140, respectively. In the non-limiting example shown, each throw assembly (e.g., 110, 112) includes a single collar (see, e.g., collar 170) disposed adjacent to the corresponding throw (e.g., throw 140). It will be appreciated that the throw assemblies 104, 106, 108, 110, 112, 114 could optionally be furnace brazed or otherwise suitably processed, for example and without limitation, to strengthened the assembly by further securing the collar (e.g., without limitation, collar 170) to the throw (e.g., without limitation, throw 140). This may be necessary or desired, for example, for relatively high amperage circuit breaker applications. It will be appreciated, however, that such brazing or other securing process may not be required in accordance with other non-limiting embodiments of the disclosed concept. For example and without limitation, relatively low amperage circuit breaker applications may not necessitate this additional strengthening process. As will be described in greater detail hereinbelow with respect to FIGS. 6-8, it will also be appreciated that more than one collar (see, e.g., collars 270,280) may be employed with each throw assembly (see, e.g., throw assembly 214).

In the example of FIGS. 3-5, each collar (see, e.g., collar 160) includes an opening 162. The elongated body portion 124 of the shaft 102 extends through the opening 162. Preferably, the collar opening 162 has a shape 163, which is substantially the same as the cross-sectional shape 126 of the elongated body portion 124 of the shaft 102. Thus, it will be appreciated that the opening 162 of example collar 160 has a hexagonal shape 163, as best shown in FIG. 3. It will be appreciated that the corresponding hexagonal shapes 126, 163 of the shaft body portion 124 and collar opening 162, respectively, facilitate the aforementioned precise and accurate positioning of the throw assembly 114 with respect to the shaft 102. It will be appreciated, however, that collars in accordance with other embodiments of the disclosed concept are not required to have such corresponding shape. For example, the opening 272 of collar 270 of FIG. 6 does not have such a corresponding shape.

As previously discussed, the throw assemblies 104, 106, 108, 110, 112, 114 are secured with respect to the shaft 102 by fasteners 116. In other words, the fasteners 116 cooperate with the collars 160 to maintain the throw assemblies 104, 106, 108, 110, 112, 114 in a precise and accurate axial position on the elongated body portion 124 of the shaft 102, perpendicular to the shaft 102. In the example shown and described herein, the fasteners 116 are blind rivets, although it will be appreciated that any known or suitable alternative number, type and/or configuration of fasteners (not shown) could be employed, without departing from the scope of the disclosed concept.

At least one of the collars 160 includes a through hole 164, and the elongated body portion 124 of the shaft 102 includes a number of receiving holes 190 (FIG. 3). The collar through hole 164 aligns with a corresponding one of the receiving holes 190 to receive a corresponding one of the fasteners 116 (e.g., without limitation, blind rivets), as shown in FIG. 5.

Referring to FIG. 3, it will be appreciated that the through hole 164 of the example collar 160 has a first diameter 166, and each of the receiving holes 190 in the shaft body portion 124 has a second diameter 192. The second diameter 192 is preferably greater than the first diameter 166, in order to permit the blind rivet 116 to expand within the shaft 102, for example after it has been actuated (e.g., without limitation, staked; pulled), to thereby secure the collar 160 to the shaft 102. In this manner, the riveted collar 160 functions to effectively retain the throw assembly 114 in the desired axial position on the shaft 102, as well as to advantageously maintain the throw assembly 114 substantially perpendicular with respect to the shaft 102, as shown. It will be further appreciated that the collars (e.g., without limitation, collar 160) can also act as a bearing surface, for example and without limitation, to facilitate rotation or pivoting of the pole shaft assembly 100.

Continuing to refer to FIG. 3, and also to FIG. 5, it will be appreciated that the pole shaft assembly 100 may have any known or suitable number and/or configuration of throw assemblies (not shown) other than the configuration of six throw assemblies 104, 106, 108, 110, 112, 114, shown. Referring, for example and without limitation, to throw assemblies 110 and 112, it will be appreciated that each throw 130 and 140 includes an extension portion 134 and 144, respectively, The extension portions 134 and 144 extend outwardly from the shaft 102 in predetermined directions 300 and 400, respectively. In at least one non-limiting embodiment, the predetermined directions 300,400 are different for at least some of the throw assemblies 110,112, as shown.

Figures 6, 7, 8:
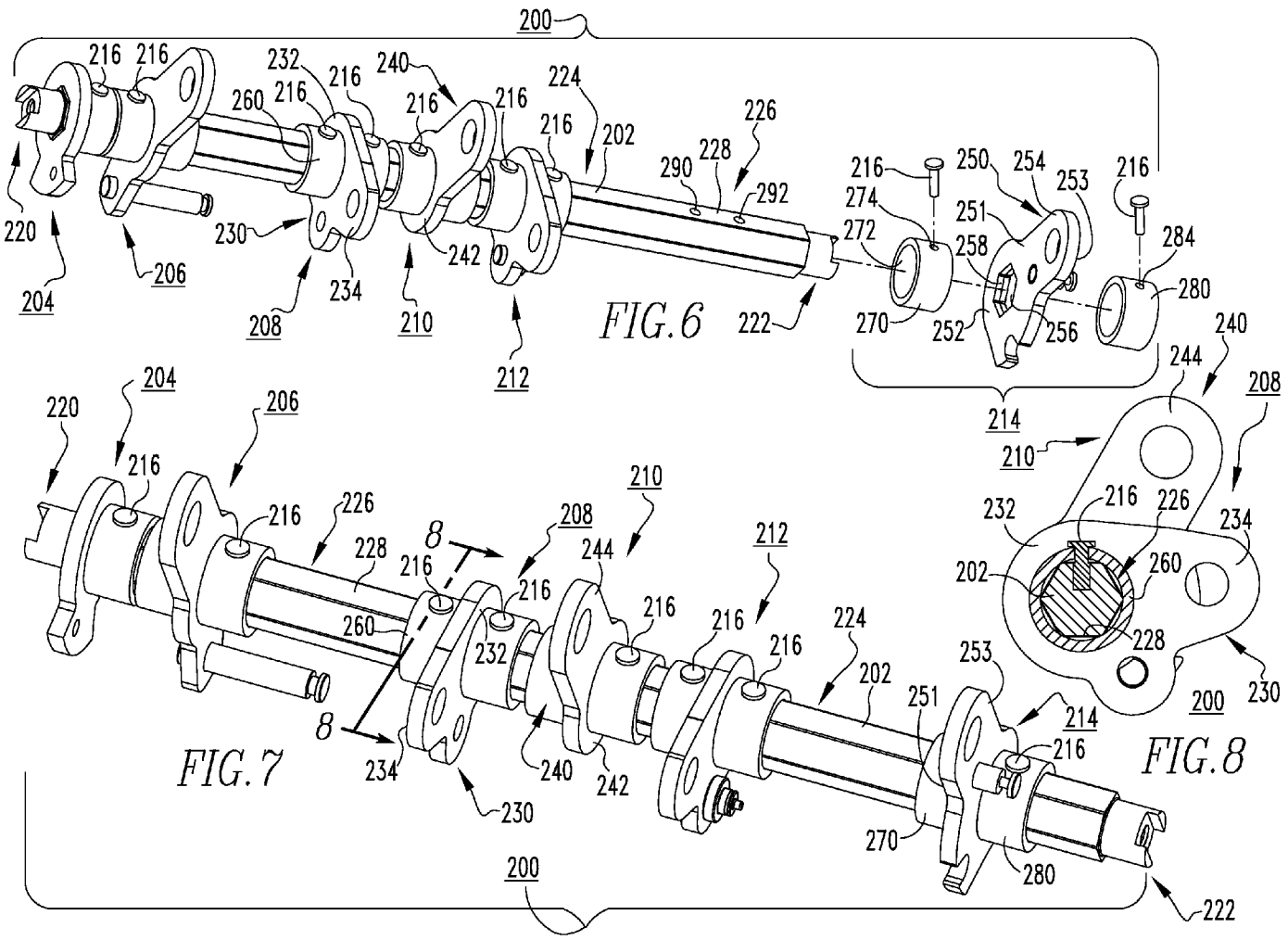
FIG. 6 is a partially exploded isometric view of a pole shaft assembly in accordance with another embodiment of the disclosed concept.
FIG. 7 is an assembled isometric view of the pole shaft assembly of FIG. 6.
FIG. 8 is a section view taken along line 8-8 of FIG. 7.

FIGS. 6-8 show a pole shaft assembly 200 in accordance with another non-limiting embodiment of the disclosed concept. The pole shaft assembly 200 is generally similar to the aforementioned pole shaft assembly 100 described hereinabove with respect to FIGS. 1-5. Among other differences, pole shaft assembly 200 employs two collars 270,280 for each throw assembly 214. More specifically, referring, for example, to throw assembly 214, it will be appreciated that throw 250 has opposing first and seconds sides 251,253. The first collar 270 is disposed on the first side 251 of the throw 250, and the second collar 280 is disposed on the second side 253 of the throw 250. In this manner, the collars 270,280 serve to maintain the desired precise axial and perpendicular position of the throw assembly 214 with respect to the shaft 202. As previously discussed, such an embodiment could be employed, for example and without limitation, in a relatively low amperage application, wherein it is not necessary to furnace braze or otherwise further secure or strengthen the throw assemblies 214.

In the example of FIG. 6-8, the pole shaft assembly 200 includes six throw assemblies 204, 206, 208, 210, 212, 214 disposed on the elongated body portion 224 of the shaft 202 between the first and second ends 220,222 thereof. The collars 260, 270, 280 are secured to the shaft 202 by fasteners 216 (e.g., without limitation, blind rivets). The blind rivets 216 extend through through holes 274,284 in the collars 270,280, respectively, and through corresponding aligned receiving holes 290,292, respectively, in the shaft body portion 224, as shown in FIG. 8 and as discussed hereinabove with respect to FIG. 5.

As best shown in FIG. 6, with respect to example throw assembly 214, each throw 250 includes an attachment portion 252 and an extension portion 254 (see also attachment portions 232,242 and extension portions 234,244 of throws 230,340 of throw assemblies 208,210, respectively). The attachment portion 252 includes an aperture 256, which preferably has a shape 258 (e.g., without limitation, hexagonal shape) substantially similar to the cross-sectional shape 226 (e.g., without limitation, hexagonal cross-sectional shape) of the elongated body portion 224 of the shaft 202, as best shown in FIG. 6.

Accordingly, it will be appreciated that the disclosed concept provides a unique pole shaft assembly 100,200 for relatively quickly, easily and inexpensively positioning a number of throw assemblies 104, 106, 108, 110, 112, 114, 204, 206, 208, 210, 212, 214 very precisely and accurately on the shaft 102,202 of the pole shaft assembly 100,200 using fasteners 116,216 (e.g., without limitation, blind rivets). A number of orienting features 128,228, such as for example and without limitation, a specific cross-sectional shaft shape 126 and correspondingly shaped apertures 136, 256, or any other non-suitable orienting features (e.g., without limitation, a key; a spline; a shape other than a hexagon (not shown)), help to establish and maintain the precise predetermined desired position of the components of the pole shaft assembly 100,200 for enhanced operation of the associated electrical switching apparatus 2 (e.g., without limitation, circuit breaker).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A pole shaft assembly for an electrical switching apparatus, said electrical switching apparatus comprising a housing, separable contacts enclosed by the housing, and an operating mechanism structured to open and close said separable contacts, said pole shaft assembly comprising:

a shaft structured to cooperate with said operating mechanism and to be pivotably coupled to the housing;

a number of throw assemblies disposed on the shaft; and a number of fasteners, wherein each of said fasteners secures a corresponding one of said throw assemblies with respect to said shaft, wherein said shaft includes a first end, a second end disposed opposite and distal from said first end, and an elongated body portion extending between the first end and the second end; and wherein the elongated body portion of said shaft has a cross-sectional shape comprising a number of orienting features, and wherein each of said throw assemblies comprises a throw including an attachment portion attached to said shaft, and an extension portion extending outwardly from said shaft; wherein said attachment portion includes an aperture; and wherein said aperture has a shape substantially similar to the cross-sectional shape of the elongated body portion of said shaft.

2. The pole shaft assembly of claim 1 wherein the elongated body portion of said shaft has a hexagonal cross-sectional shape; and wherein said aperture of said throw has a corresponding hexagonal shape.

3. The pole shaft assembly of claim 1 wherein each of said throw assemblies further comprises at least one collar disposed on the elongated body portion adjacent to said throw.

4. The pole shaft assembly of claim 3 wherein said throw further includes a first side and a second side disposed opposite the first side; and wherein said at least one collar is a first collar disposed on the first side of said throw and a second collar disposed on the second side of said throw.

5. The pole shaft assembly of claim 3 wherein said at least one collar includes an opening; wherein the elongated body portion of said shaft extends through said opening; and wherein said opening of at least one of said at least one collar has a shape substantially the same as the cross-sectional shape of the elongated body portion of said shaft.

6. The pole shaft assembly of claim 3 wherein said at least one collar includes a through hole; wherein the elongated body portion of said shaft includes a number of receiving holes; and wherein said through hole aligns with a corresponding one of said receiving holes to receive a corresponding one of said fasteners.

7. The pole shaft assembly of claim 6 wherein said number of fasteners is a number of blind rivets; wherein said through hole has a first diameter; wherein each of said receiving holes has a second diameter; and wherein the second diameter is greater than the first diameter.

8. The pole shaft assembly of claim 1 wherein at least one of said throw assemblies is furnace brazed.

9. The pole shaft assembly of claim 1 wherein said number of throw assemblies is a plurality of throw assemblies each comprising a throw; wherein each throw includes an extension portion extending outwardly from said shaft in a predetermined direction; and wherein the predetermined direction is different for at least some of said throw assemblies.

10. An electrical switching apparatus comprising:

a housing;

separable contacts enclosed by the housing;

an operating mechanism for opening and closing said separable contacts; and a pole shaft assembly comprising:

a shaft cooperating with said operating mechanism and pivotably coupled to the housing, a number of throw assemblies disposed on the shaft, and a number of fasteners, wherein each of said fasteners secures a corresponding one of said throw assemblies with respect to said shaft, and wherein said shaft includes a first end, a second end disposed opposite and distal from said first end, and an elongated body portion extending between the first end and the second end; wherein the elongated body portion of said shaft has a cross-sectional shape comprising a number of orienting features; wherein each of said throw assemblies comprises a throw including an attachment portion attached to said shaft, and an extension portion extending outwardly from said shaft; wherein said attachment portion includes an aperture; and wherein said aperture has a shape substantially similar to the cross-sectional shape of the elongated body portion of said shaft.

11. The electrical switching apparatus of claim 10 wherein the elongated body portion of said shaft has a hexagonal cross-sectional shape; and wherein said aperture of said throw has a corresponding hexagonal shape.

12. The electrical switching apparatus of claim 10 wherein each of said throw assemblies further comprises at least one collar disposed on the elongated body portion adjacent to said throw.

13. The electrical switching apparatus of claim 12 wherein said throw further includes a first side and a second side disposed opposite the first side; and wherein said at least one collar is a first collar disposed on the first side of said throw and a second collar disposed on the second side of said throw.

14. The electrical switching apparatus of claim 12 wherein said at least one collar includes an opening; wherein the elongated body portion of said shaft extends through said opening; and wherein said opening of at least one of said at least one collar has a shape substantially the same as the cross-sectional shape of the elongated body portion of said shaft.

15. The electrical switching apparatus of claim 12 wherein said at least one collar includes a through hole; wherein the elongated body portion of said shaft includes a number of receiving holes; and wherein said through hole aligns with a corresponding one of said receiving holes to receive a corresponding one of said fasteners.

16. The electrical switching apparatus of claim 15 wherein said number of fasteners is a number of blind rivets; wherein said through hole has a first diameter; wherein each of said receiving holes has a second diameter; and wherein the second diameter is greater than the first diameter.

17. The electrical switching apparatus of claim 10 wherein said electrical switching apparatus is a circuit breaker; wherein said number of throw assemblies is a plurality of throw assemblies each comprising a throw; wherein each throw includes an extension portion extending outwardly from said shaft in a predetermined direction; and wherein the predetermined direction is different for at least some of said throw assemblies.

* * * * *